US010082262B2

(12) United States Patent
Butler et al.

(10) Patent No.: US 10,082,262 B2
(45) Date of Patent: Sep. 25, 2018

(54) LIGHT FIXTURE COUPLER

(71) Applicant: ABL IP Holding LLC, Decatur, GA (US)

(72) Inventors: Doyle Scott Butler, Atlanta, GA (US); Robert Wayne Mock, Jr., Lawrenceville, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 15/298,653

(22) Filed: Oct. 20, 2016

(65) Prior Publication Data

US 2018/0112842 A1 Apr. 26, 2018

(51) Int. Cl.

| | |
|---|---|
| ***F21S 8/06*** | (2006.01) |
| ***F21V 21/005*** | (2006.01) |
| ***F21V 17/12*** | (2006.01) |
| ***F21V 3/00*** | (2015.01) |
| *F21Y 115/15* | (2016.01) |
| *F21Y 115/10* | (2016.01) |

(52) U.S. Cl.

CPC ..... *F21S 8/063* (2013.01); *F21V 3/00* (2013.01); *F21V 17/12* (2013.01); *F21V 21/005* (2013.01); *F21Y 2115/10* (2016.08); *F21Y 2115/15* (2016.08)

(58) Field of Classification Search

CPC ..... F21S 8/063; F21V 21/005

See application file for complete search history.

(56) References Cited

U.S. PATENT DOCUMENTS

| | | | | |
|---|---|---|---|---|
| D743,090 | S | 11/2015 | Wilcox et al. | |
| 9,188,294 | B1 | 11/2015 | Wegner et al. | |
| 2011/0058358 | A1* | 3/2011 | Soo | F21S 8/02 362/147 |
| 2015/0373806 | A1 | 12/2015 | Vissenberg et al. | |

* cited by examiner

*Primary Examiner* — Joseph L Williams

(74) *Attorney, Agent, or Firm* — Kilpatrick Townsend & Stockton LLP

(57) ABSTRACT

A modular lighting assembly includes two modular segments, each having a frame member. A coupler for forming an assembly, and an assembly formed by the coupler. In one example implementation, two members having abutment faces are drawn together using a coupler. Each of the members has a T having a T-shaped cross section, and the coupler has channel with a T-shaped cross section. The channel receives the ends of the rails. Each rail has an opening in its top face. Two screws are threaded into a back of the coupler and angled toward a center of the coupler, such that the ends of the screws engage sidewalls of the openings in the rails. As the screws are advanced into the coupler body, the ends of the screws are drawn together, drawing together the abutment faces of the two members. In other implementations, other rail and channel shapes may be used.

20 Claims, 5 Drawing Sheets

LIGHT FIXTURE COUPLER

BACKGROUND OF THE INVENTION

A common requirement in the design of mechanical assemblies is the joining of members in an aligned fashion. For example, lighting fixtures may be assembled from a number of segments coupled together. It is desirable for the coupling to provide a secure attachment and to be easy to assemble, while aligning the segments.

SUMMARY OF THE INVENTION

According to one aspect, a lighting fixture comprises a first modular segment comprising one or more light sources mounted to a first frame member. The first frame member has a first abutment face and a first rail. The lighting fixture further comprises a second modular segment comprising one or more light sources mounted to a second frame member, wherein the second frame member has a second abutment face and a second rail. The lighting fixture also comprises a coupler that receives the first and second rails and aligns the first and second frame members and draws the first and second abutment faces into contact.

According to another aspect, an assembly for use in a lighting fixture comprises a first member having a first abutment face. The first member includes a first rail having an undercut cross section and the first rail having a first top face, and the first rail defines a first opening set back from the first abutment face and having an axis transverse to the first top face. The assembly further comprises a second member having a second abutment face. The second member includes a second rail having an undercut cross section and the second rail having a second top face, and the second rail defines a second opening set back from the second abutment face and having an axis transverse to the second top face. The assembly further comprises a coupler body defining a channel through the body. The body includes a back and two sides extending forward of the back to define the channel, and the body has two ends. The channel has a cross section complementary to the cross sections of the first and second rails and is of a size and shape to receive the first and second rails into the channel from opposite ends of the coupler body. The coupler body defines two threaded holes through the back of the coupler body. Each of the two threaded holes is disposed proximate a respective end of the coupler body and angled inward toward a center of the body. The assembly further comprises two screws, one of the two screws threaded into each of the two threaded holes, such that when the rails of the two members are inserted into the channel of the body and the screws are advanced into the body, the tips of the screws engage sidewalls of the first and second openings in the first and second rails, drawing the first and second abutment faces together.

According to another aspect, a coupler comprises a body defining a channel having an undercut cross section. The channel extends through the body. The body includes a back and two sides extending forward of the back to define the channel, and the body has two ends. The coupler further comprises two screws threaded through the back of the body, one of the two screws proximate each of the two ends of the body. Each of the two screws is angled inwardly toward a center of the body such that advancing the screws into the body from the back of the body advances the screws into and along the channel and draws the screws closer together.

DETAILED DESCRIPTION

Embodiments of the present invention relate to a coupler for conveniently joining members into an assembly. In some embodiments, the assembly may be comprised in a lighting fixture.

Figure 1:
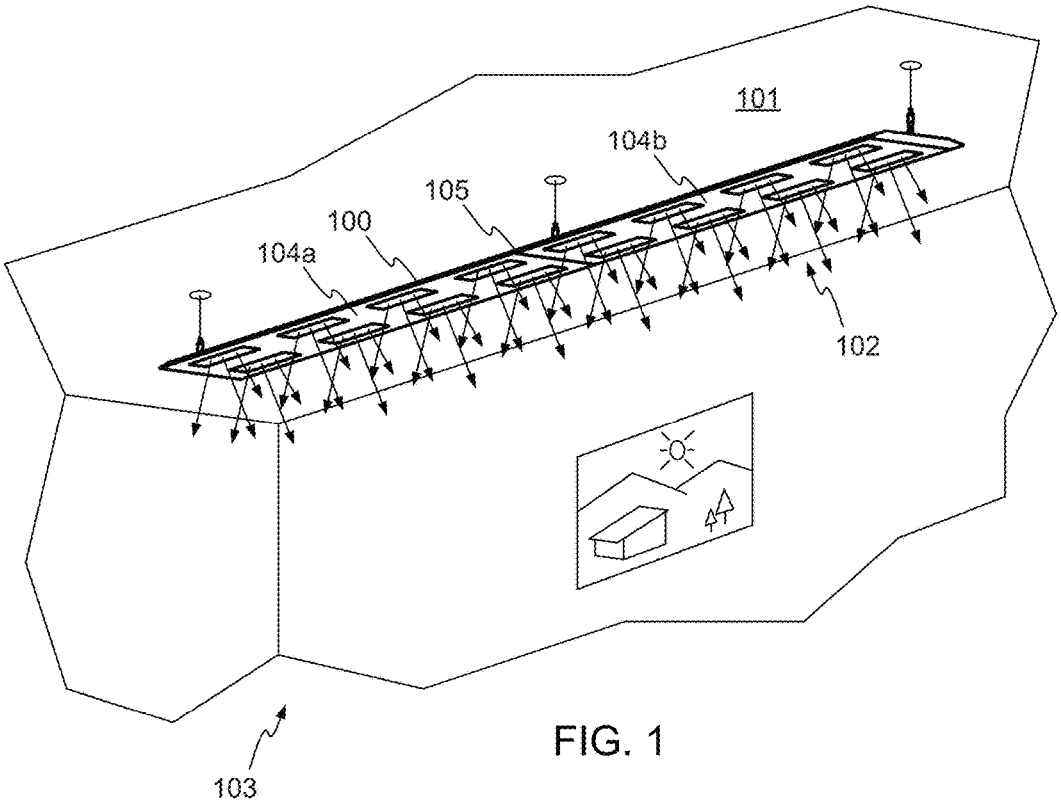
FIG. 1 illustrates a lighting fixture in accordance with embodiments of the invention.

FIG. 1 illustrates a lighting fixture 100 in accordance with embodiments of the invention. It will be understood, however, that the invention is not limited to use with the particular lighting fixtures illustrated or in lighting fixtures at all; rather, embodiments of the invention may be used in a wide variety of other applications.

The lighting fixture 100 is suspended from a ceiling 101, and directs light 102 downward into room 103. The lighting fixture 100 includes two modular segments 104*a* and 104*b*, which abut at joint 105. While the modular segments 104*a* and 104*b* could be mounted with space between them, in some installations it may be desirable for the modular segments 104*a* and 104*b* to abut one another for a sleek, continuous look. Fixtures of any workable length may be constructed using more than two sections.

Figure 2:
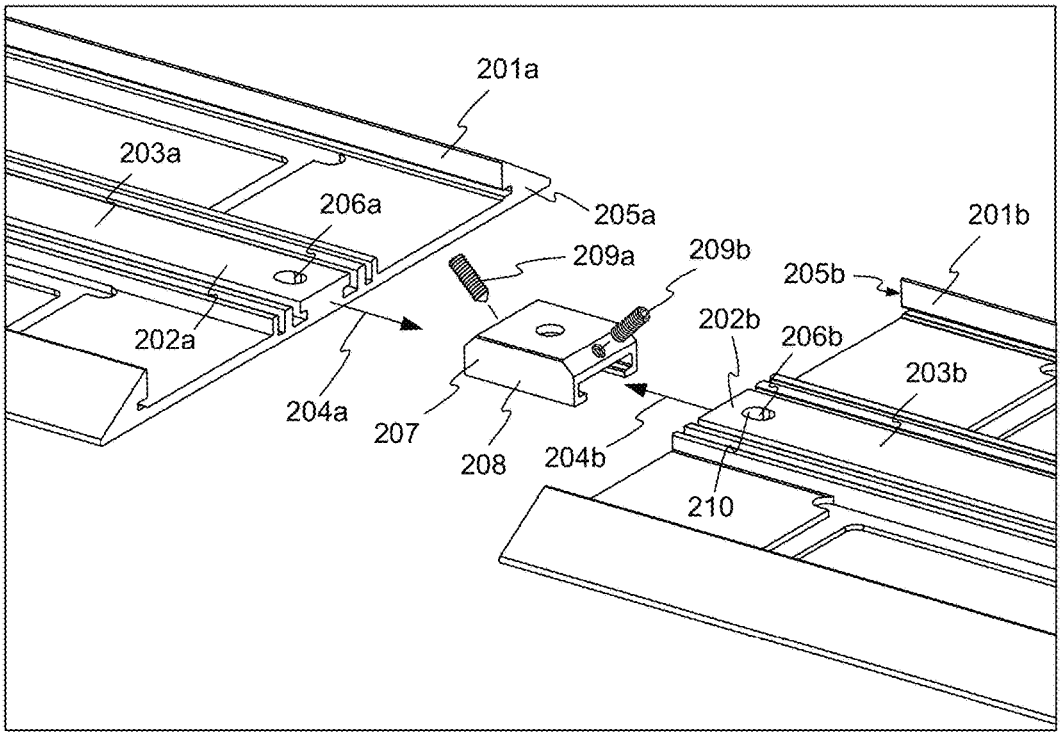
FIG. 2 illustrates an exploded view of some parts of the lighting fixture of FIG. 1, in accordance with embodiments of the invention.

FIG. 2 illustrates an exploded view of some parts of the lighting fixture 100, in accordance with embodiments of the invention. In FIG. 2, many parts of the lighting fixture 100 are omitted for clarity, including the actual light sources, wiring, shielding, electronics, and the like.

In the example of FIG. 2, each of the lighting fixture segments 104*a* and 104*b* includes a frame member 201*a*, 201*b*. The frame members 201*a*, 201*b* may be, for example, extruded aluminum parts with secondary machining, but the frame members 201*a*, 201*b* may be made of any suitable material by any suitable process.

Each of the frame members 201*a*, 201*b* comprises a rail 202*a*, 202*b* having a T-shaped cross section. The broadest surface of each rail, furthest from the base of the respective rail, will referred to as the "top" surface 203*a*, 203*b*, but it is to be understood that the designation "top" is merely to identify the surface itself, and is not intended to limit the invention to a particular spatial orientation. Each rail 202*a*, 202*b* also has a longitudinal axis 204*a*, 204*b*. Each frame member 201*a*, 201*b* has an abutment face 205*a*, 205*b* (only one of which is visible in FIG. 2), for abutting together as is described in more detail below. While the abutment faces 205*a*, 205*b* shown in FIG. 2 are planar, this is not a requirement.

Each of the rails 203*a*, 203*b* also defines an opening 206*a*, 206*b*, set back from the respective abutment face 205*a*, 205*b* so that part of the material of the rail is disposed between the opening 206*a*, 206*b* and the respective abutment face 205*a*, 205*b*. The opening 206*a*, 206*b* may be a blind hole or a through hole, formed perpendicular to the top face 203*a*,

203*b*. Each opening 206*a*, 206*b* may have an axis transverse to its respective top face 203*a*, 203*b* so as to have a substantially vertical side wall 210 (only one of which is visible in FIG. 2). However, it should be understood that the axis of each opening 206*a*, 206*b* could be other than perpendicular to the top face 203*a*, 203*b*.

Figure 3:
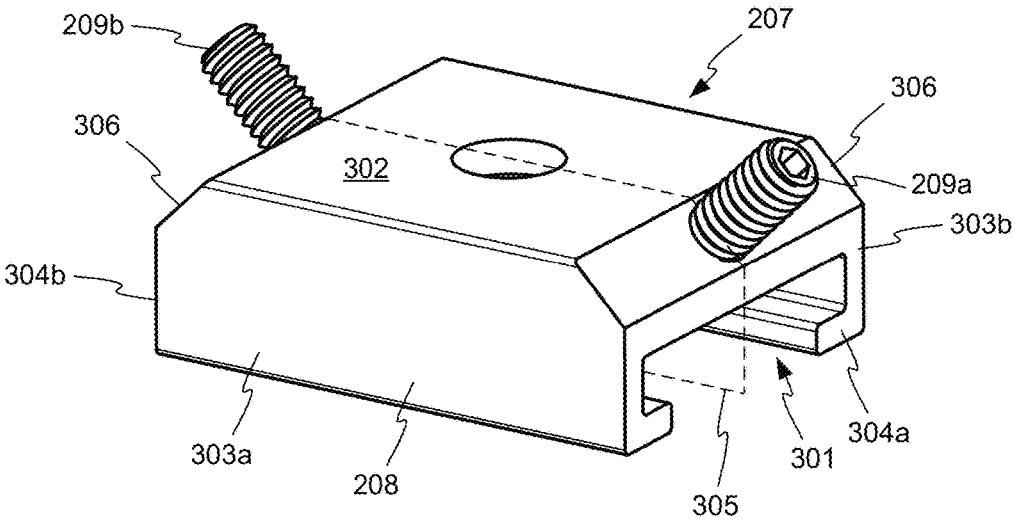
FIG. 3 illustrates a coupler in accordance with embodiments of the invention.

A coupler 207 including a coupler body 208 and two screws 209*a*, 209*b* is configured for joining the two frame members 201*a*, 201*b*, and is shown in more detail in FIG. 3. The coupler body 208 defines a T-shaped through channel 301. The coupler body 208 includes a back 302 and two sides 303*a*, 303*b* that extend forward of the back 302 to define the channel 301, and the coupler body 208 has two ends 304*a*, 304*b*. The T-shaped through channel 301 is of a size and shape to receive the ends of the T-shaped rails 202*a*, 202*b* of the frame members 201*a*, 201*b* from opposite ends of the coupler body. The two screws 209*a*, 209*b* are threaded into threaded holes (not visible) in the back of the coupler body 208, one near each of the ends 304*a*, 304*b*. In the example shown, the two screws 209*a*, 209*b* are setscrews, but any suitable threaded fastener may be used for the screws.

The T-shaped through channel 301 is an example of a channel having an undercut cross section. For the purposes of this disclosure, a channel having an "undercut" cross section is one in which the open side of the channel is narrower than the width of the channel within the coupler. Another example of a channel having an undercut cross section is a dovetail-shaped channel. Similarly, the T-shaped rails 202*a*, 202*b* are examples of rails having an undercut cross section. For the purposes of this disclosure, a rail having an "undercut" cross section is one in which the rail is narrower at its base that at its top.

When the rails are linear, the coupler body 208 may be symmetrical about a central plane of symmetry 305, with the screws 209*a*, 209*b* disposed in the plane of symmetry. The screws 209*a*, 209*b* are angled inward, such that advancing either screw 209*a*, 209*b* draws the two screws closer together. The ends 304*a*, 304*b* of the coupler body 208 may be beveled 306, and the screws 209*a*, 209*b* may be disposed with their longitudinal axes perpendicular to the bevel faces.

To use the coupler 207 to join the frame members 201*a*, 201*b* together, the T-shaped rails 202*a*, 202*b* of the frame members are inserted into the T-shaped channel 301 of the coupler body 202. The screws 209*a*, 209*b* are then advanced into the openings 206*a*, 206*b* in the frame members 201*a*, 201*b* where they contact inner surfaces of the openings 206*a*, 206*b*. As the screws 209*a*, 209*b* advance, the frame members 201*a*, 201*b* are drawn together so that their abutment faces 205*a*, 205*b* meet.

Figure 4:
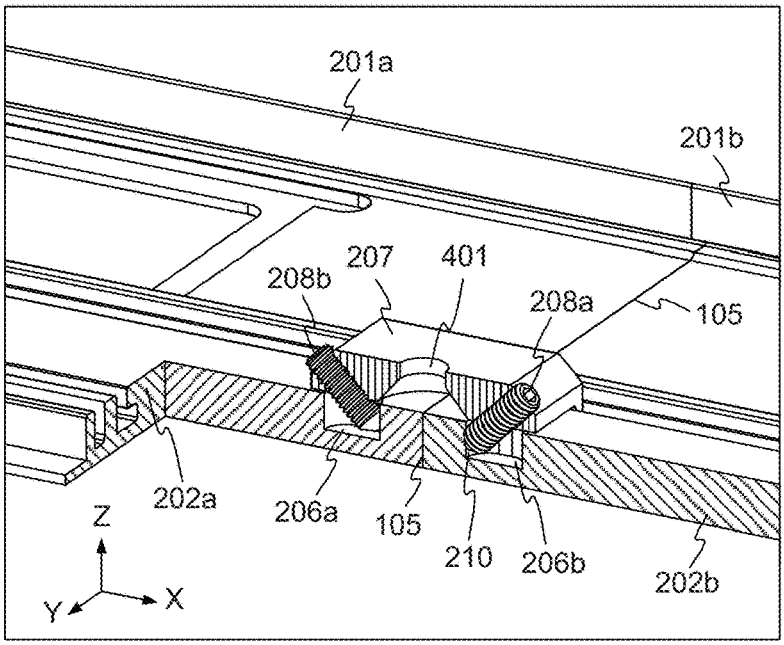
FIG. 4 illustrates a cutaway view of a joint created in accordance with embodiments of the invention.

FIG. 4 illustrates a cutaway view of the resulting joint 105 once the frame members have been joined. The screws 209*a* and 209*b* have been advanced into the coupler body 208 and into the openings 206*a* and 206*b*. The conical tips of the screws 209*a*, 209*b* have engaged side walls of the openings 206*a*, 206*b*, and the advancing action of the screws has forced the abutment faces (not visible) of the frame members 201*a*, 201*b* together in the "X" direction at the joint 105, drawing the frame members 201*a*, 201*b* into the desired alignment in the "X" direction.

Although other screw tip shapes may be used, conical tips may be preferred, angled to result in line contact with the side walls 210 of the openings 206*a*, 206*b*. The line contact may reduce the amount of distortion or damage done to the walls by the screw tips.

In addition to abutting the frame members together, the assembly process may align the frame members 201*a*, 201*b* in other degrees of freedom as well. The engagement of the T-shaped rails 202*a*, 202*b* with the channel 301 of the coupler body 208 also constrains the alignment of the frame members 201*a*, 201*b* in the "Y" and "Z" directions shown in FIG. 4.

Also visible in FIG. 4 is an opening 401 through the back of the coupler body 208. The opening 401 may be used, for example, for attaching other items to the coupler body 208, as is explained in more detail below. In the example of FIG. 4, the opening 401 has an axis in the plane of symmetry 305 of the channel 301 of the coupler body 208, and the opening 401 is larger at an inner surface of the back of the body 208 than at an outer surface of the back of the body 208. For example, the opening 401 may be countersunk into the coupler body 208.

It will be recognized that the joint formed by the coupler 207 does not rely on the screws 209*a*, 209*b* or any other fastener to support the weight of the lighting fixture. Rather, the coupler body 208 bears the lighting fixture weight. The screws 209*a*, 209*b* merely urge and hold the frame members 201*a*, 201*b* together within the coupler 207.

Figure 5:
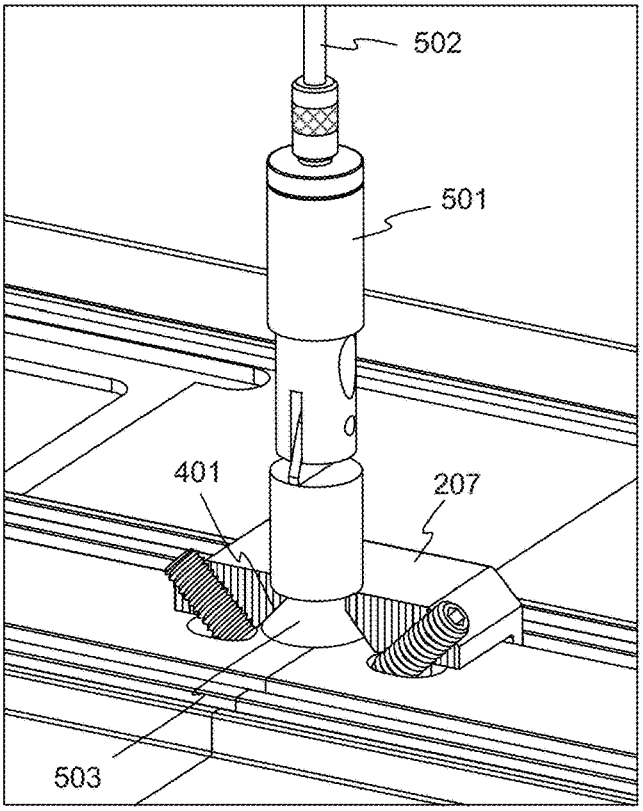
FIG. 5 illustrates a partially-cutaway view of an assembly in accordance with other embodiments.

FIG. 5 illustrates a partially-cutaway view of an assembly in accordance with other embodiments. In the embodiment of FIG. 5, a hanger 501 has been attached to the coupler body 208. When the assembly of FIG. 5 is included in a lighting fixture, the hanger 501 may be used to suspend the lighting fixture including the assembly from a ceiling or the like via a wire, cable, or similar element 502. The hanger 501 may attach to the coupler body 208 in any suitable way, for example via a flat head screw 503 within the countersunk opening 401. In other embodiments, the hanger may be attached with a different kind of fastener, may be threaded directly into the coupler body 208, may be crimped to the coupler body 208, or attached in another way. The hanger 501 may be made of any suitable material by any suitable process, but may preferably be made of steel or another material with adequate strength to hold the flat head screw 503 to bear the weight of the lighting fixture.

Figure 6:
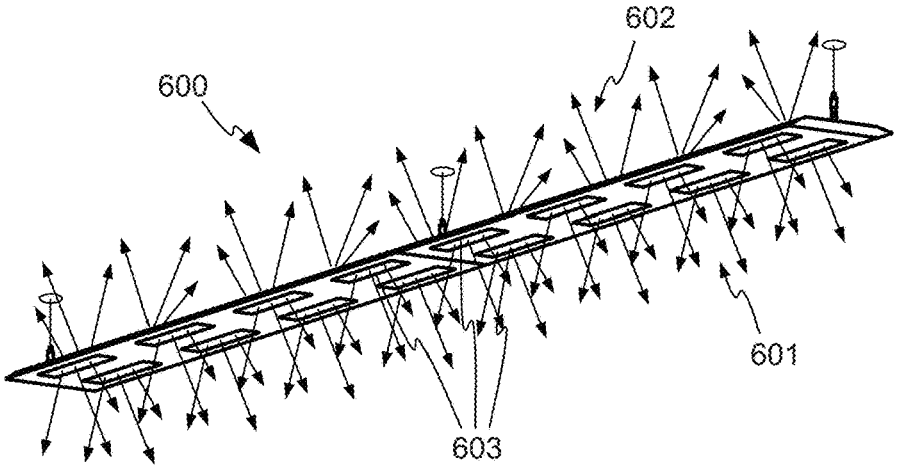
FIG. 6 illustrates a light fixture in accordance with other embodiments of the invention.

FIG. 6 illustrates a light fixture 600 in accordance with other embodiments of the invention. The lighting fixture 600 is similar to the lighting fixture 100 shown in FIG. 1, in that it comprises multiple segments joined together, and produces direct downlight 601. In addition, the lighting fixture 600 produces uplight 602, which may reflect from the ceiling, providing indirect lighting to the room in which the lighting fixture 600 is installed.

In some embodiments, the lighting fixture 600 may comprise a number of organic light emitting diode (OLED) light sources 603 oriented to direct light downward. The OLED light sources 603 may preferably be flat panels that produce diffuse light. The wavelength content of the downlight 601 (and therefore the color of the downlight 601) may be selected for particular uses, and may be adjustable.

Figure 7:
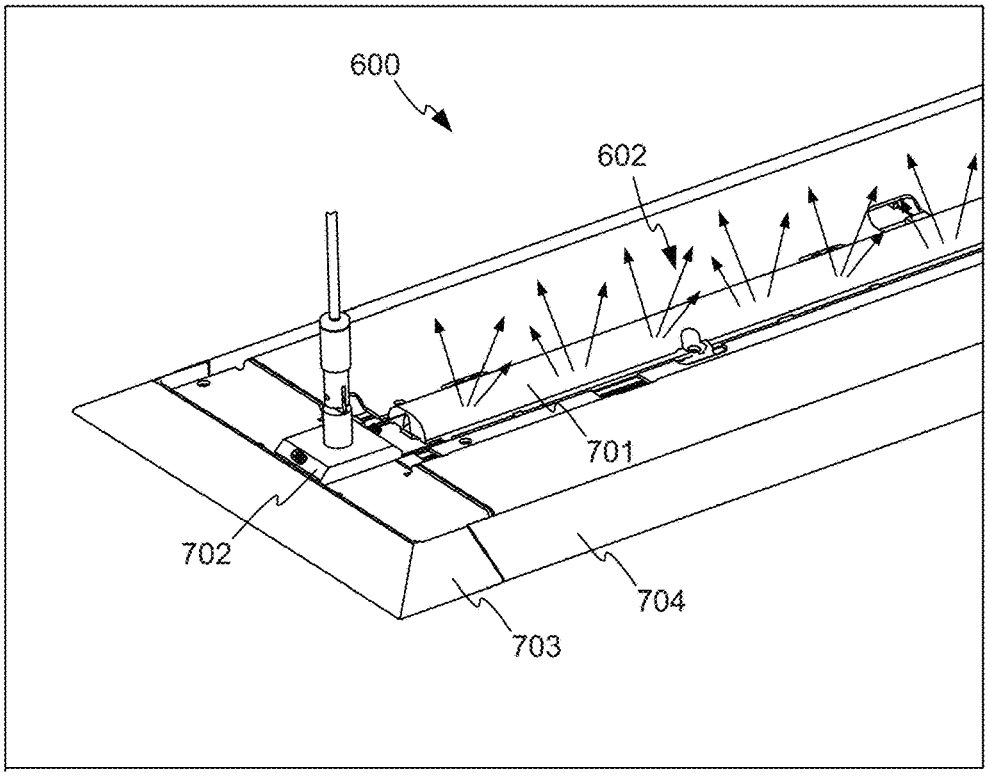
FIG. 7 illustrates the lighting fixture of FIG. 6 from above.

FIG. 7 illustrates a portion the lighting fixture 600 from above. A lens 701 covers a number of other light sources (not visible in FIG. 7), for example light emitting diode (LED) light sources, directed upwardly toward the ceiling from which the lighting fixture 600 may be suspended. The lens 701 may direct the light in any desired way, for example causing the light to diverge, to be diffused, to be concentrated, or in another way. The wavelength content of the uplight 602 (and therefore the color of the uplight 602) may be selected for particular uses, and may be adjustable.

FIG. 7 also illustrates the use of a coupler 702 of the type previously described to join an endcap 703 to a frame member 704 of the lighting fixture 600, to provide a finished look at the end of the row of joined light fixture segments.

Figure 8:
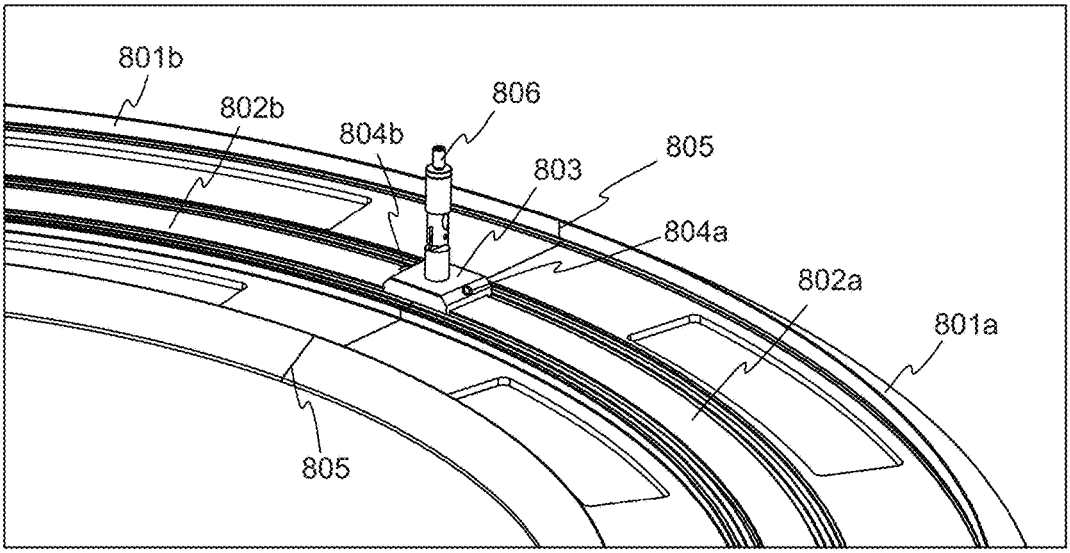
FIG. 8 illustrates the use of a coupler in accordance with embodiments of the invention to form a ring-shaped assembly.

While the embodiments described above use a linear rail engaged with a linear channel, this is also not a requirement. For example, FIG. 8 illustrates the use of a coupler in accordance with embodiments of the invention to form a ring-shaped assembly, such as the frame of a ring-shaped lighting fixture. In the example of FIG. 8, two frame members 801*a*, 801*b* form a part of a ring-shaped structure. Each of the frame members 801*a*, 801*b* includes a T-shaped rail 802*a*, 802*b*. A coupler 803, similar to the coupler 207 described above, receives the ends of the T-shaped rails 802*a*, 802*b*, and two screws 804*a*, 804*b* draw the frame members 801*a*, 801*b* together to form a joint 805. Hangers 806 may be installed, for suspending the ring-shaped structure from ceiling or the like. In the example of FIG. 8, the T-shaped rails 802*a*, 802*b* and the channel in the coupler 803 are curved rather than straight. In addition, the coupler 803 does not have a central plane of symmetry aligned with the channel, as the channel through the coupler 803 is not straight.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the invention.

What is claimed is:

1. A lighting fixture, comprising:

a first modular segment comprising one or more light sources mounted to a first frame member, wherein the first frame member has a first abutment face and a first rail, wherein the first rail has a first longitudinal axis;

a second modular segment comprising one or more light sources mounted to a second frame member, wherein the second frame member has a second abutment face and a second rail, wherein the second rail has a second longitudinal axis; and a coupler that receives the first and second rails and aligns the first and second frame members and draws the first and second abutment faces together in a direction parallel to the first and second longitudinal axes and into contact.

2. The lighting fixture of claim 1, wherein:

the first rail has an undercut cross section and the first rail has a first top face, wherein the first rail defines a first opening in the first top face, the first opening set back from the first abutment face;

the second rail has an undercut cross section and the second rail has a second top face, wherein the second rail defines a second opening in the second top face, the second opening set back from the second abutment face;

the coupler comprises a coupler body defining a channel through the body, the body including a back and two sides extending forward of the back to define the channel, and the body having two ends, wherein the channel has a cross section complementary to the cross section of the first and second rails and is of a size and shape to receive the first and second rails into the channel from opposite ends of the coupler body, and the coupler body defining two threaded holes through the back of the coupler body, each of the two threaded holes being disposed proximate a respective end of the coupler body and angled inward toward a center of the body; and the coupler comprises two screws, one of the two screws threaded into each of the two threaded holes, such that when the rails of the two members are inserted into the channel of the body and the screws are advanced into the body, the tips of the screws engage sidewalls of the first and second openings in the first and second rails, drawing the first and second abutment faces together.

3. The lighting fixture of claim 2, wherein the coupler body aligns the first and second members in three degrees of freedom.

4. The lighting fixture of claim 2, wherein the first and second frame members and the coupler body have substantially uniform cross sections suitable for initial formation by extrusion.

5. The lighting fixture of claim 2, further comprising a hanger extending from the back of the coupler body, configured for hanging the assembly from an overhead structure.

6. The lighting fixture of claim 2, wherein the lighting fixture is configured to be suspended from a ceiling, and wherein the one or more light sources in either or both of the modular segments include one or more organic light emitting diode (OLED) light sources oriented to direct light downward away from the ceiling, and one or more other light emitting diode (LED) light sources oriented to direct light upward for reflection from the ceiling.

7. The lighting fixture of claim 2, wherein each of the screws has a conical tip angled for line engagement with the sidewall of its respective opening in the first or second frame member.

8. The lighting fixture of claim 2, wherein each of the first and second rails has a T-shaped cross section and the channel has a T-shaped cross section, or each of the first and second rails has a dovetail-shaped cross section and the channel has a dovetail-shaped cross section.

9. An assembly for use in a lighting fixture, the assembly comprising:

a first member having a first abutment face, the first member including a first rail having an undercut cross section and the first rail having a first top face, wherein the first rail defines a first opening set back from the first abutment face and having an axis transverse to the first top face;

a second member having a second abutment face, the second member including a second rail having an undercut cross section and the second rail having a second top face, wherein the second rail defines a second opening set back from the second abutment face and having an axis transverse to the second top face;

a coupler body defining a channel through the body, the body including a back and two sides extending forward of the back to define the channel, and the body having two ends, wherein the channel has a cross section complementary to the cross sections of the first and second rails and is of a size and shape to receive the first and second rails into the channel from opposite ends of the coupler body, and the coupler body defining two threaded holes through the back of the coupler body, each of the two threaded holes being disposed proximate a respective end of the coupler body and angled inward toward a center of the body; and two screws, one of the two screws threaded into each of the two threaded holes, such that when the rails of the two members are inserted into the channel of the body and the screws are advanced into the body, the tips of the screws engage sidewalls of the first and second openings in the first and second rails, drawing the first and second abutment faces together.

10. The assembly of claim 9, wherein the assembly aligns the first and second members in three degrees of freedom.

11. The assembly of claim 9, wherein the first and second members and the coupler body have substantially uniform cross sections suitable for initial formation by extrusion.

12. The assembly of claim 9, further comprising a hanger extending from the back of the coupler body, configured for hanging the assembly from an overhead structure.

13. The assembly of claim 9, wherein each of the screws has a conical tip angled for line engagement with the sidewall of its respective opening in the first or second member.

14. The assembly of claim 9, wherein each of the first and second rails has a T-shaped cross section and the channel has a T-shaped cross section, or each of the first and second rails has a dovetail-shaped cross section and the channel has a dovetail-shaped cross section.

15. A coupler, comprising:

a body defining a channel having an undercut cross section, the channel extending through the body, the body including a back and two sides extending forward of the back to define the channel, and the body having two ends;

two screws threaded through the back of the body, one of the two screws proximate each of the two ends of the body, each of the two screws angled inwardly toward a center of the body such that advancing the screws into the body from the back of the body advances the screws into and along the channel and draws the screws closer together.

16. The coupler of claim 15, wherein each of the two screws is a setscrew positioned for actuation from the back side of the body.

17. The coupler of claim 15, wherein the back of the body defines an opening through the back of the body, the opening being larger at an inner surface of the back of the body than at an outer surface of the back of the body.

18. The coupler of claim 15, wherein the channel is straight.

19. The coupler of claim 15, wherein each of the screws has a conical tip.

20. The coupler of claim 15, wherein the channel is T-shaped or dovetail-shaped.

* * * * *